United States Patent [19]

Dubois

[11] 4,041,957

[45] Aug. 16, 1977

[54] SLENDERIZING LADIES' ROLL-ON BELT OF IMPROVED COMFORT

[76] Inventor: Guy Dubois, Avenue Lorette 9, Ohain, Belgium

[21] Appl. No.: 637,191

[22] Filed: Dec. 3, 1975

[30] Foreign Application Priority Data

Dec. 10, 1974 Belgium ..... 151341
June 12, 1975 Belgium ..... 157275

[51] Int. Cl.[2] ..... A41C 1/00
[52] U.S. Cl. ..... 128/540
[58] Field of Search ..... 128/498, 526, 527, 528, 128/542, 554, 546-548, 539-540

[56] References Cited

U.S. PATENT DOCUMENTS

| | | | |
|---|---|---|---|
| 2,168,009 | 8/1939 | Van Praag | 128/547 |
| 2,397,641 | 4/1946 | Blair | 128/526 |
| 2,610,324 | 9/1952 | Dowd | 128/548 X |
| 2,705,799 | 4/1955 | Frischer | 128/548 |
| 2,803,822 | 8/1957 | Doyle | 128/554 |
| 3,005,459 | 10/1961 | Geissmann | 128/528 |
| 3,161,201 | 12/1964 | Welsch | 128/548 |
| 3,246,650 | 4/1966 | Wells | 128/528 |
| 3,255,756 | 6/1966 | Frei | 128/548 |
| 3,262,453 | 7/1966 | Diebold | 128/542 |
| 3,437,092 | 4/1969 | Salisky | 128/542 |
| 3,699,971 | 10/1972 | Sachs et al. | 128/491 |

*Primary Examiner*—G. V. Larkin
*Attorney, Agent, or Firm*—Koenig, Senniger, Powers and Leavitt

[57] ABSTRACT

An elastic underwear garment which consists at least for its major part of elastic fabric the resilient fibers of which extend obliquely with respect to the longitudinal axis of the garment and form with said axis an angle at most equal to 60°.

5 Claims, 17 Drawing Figures

SLENDERIZING LADIES' ROLL-ON BELT OF IMPROVED COMFORT

The present invention relates to underclothes or like underwear or undergarments such as elastic or resilient ladies' roll-on belts or like girdles enabling slenderizing or slimming of the figure and which would be worn under conditions of improved comfort or ease in the standing as well as in the sitting position.

In the present specification the term "underwear" or "belt" is used in a wide sense or meaning as the present invention is directed as well to an abdominal belt as to a pantie girdle, a maternity corset, a combination of belt or girdle and bust-bodice or brassiere referred to hereinafter as "corselet", a bathing suit or swim suit, a brassiere or bust-bodice, and so on.

The conventional abdominal belts or girdles made from a resilient fabric or elastic cloth offer the inconvenience of tightening or squeezing the abdomen and of overloading the perineum; moreover the pantie-girdles of resilient character generally exhibit a structure adapted to relieve the strain or to ease pressure on the perineum but however the abdomen remains squeezed whereas the thighs are tightened or squeezed by the legs of the girdle or, in other words, by those portions thereof which form the breech parts, trunk-hose portions, hip portions or top portions of the thighs.

These drawbacks of prior art elastic ladies' roll-on belts or pantie-girdles are overcome by the belt or girdle according to the present invention which does not tighten or squeeze any part of the body and which however will reduce the abdomen as well as the thighs and raise or lift up the perineum; moreover this belt or girdle will bring about during movement of the individual who is wearing same a massage of the body thereby strengthening or bracing up the abdominal and perineal musculature without hindering, interfering with or holding up the circulation of blood in any way.

The elastic belt or girdle according to the invention is characterized in that it is made at least for its major part from a resilient fabric or like elastic cloth the lines of force of which are slanting or oblique with respect to the longitudinal centre line axis of the belt or girdle, their obliquity or skew being such that they form with said centre line axis an angle at most equal to about 60° C.

Such orientation of the lines of force, i.e., of the elastic fibres or filaments of the fabric provides great comfort since they correspond to the arrangement which would impede or oppose in the least degree the usual movements of the body and limbs and which would reduce to the largest extent the tightening or squeezing effect contrary to the ladies' roll-on belts and in particular in opposition to the pantie girdles generally in use which would squeeze the belly and the top portions of the thighs owing to the substantial transverse or crosswise arrangement of the resilient fibres or in other words of the zero, small or relatively small value of the angle the lines of force are making with the transverse direction of the belt or girdle.

According to a preferred form of embodiment of the present invention, in that part of the girdle which forms the slip or briefs or the jacket or breast portions in the case of a corselet the lines of force of the elastic fabric are distributed in a pair of systems or patterns of lines of force extending in parallel relation to each other in each system or pattern and crossing each other from one system to the other; that portion may consist of one single layer of fabric in which two directions of elastic fibres would co-exist or in a more advantageous fashion as will be seen hereinafter of the superposition of two fabric layers in each one of which the various resilient fibres have the same orientations.

According to another characterizing feature of the present invention on the front or fore-part as well as on the back side of those portions forming the tops of the thighs (and possibly the upper sides of the girdle in the case of a corselet) the lines of force of the left portion are crossing those of the right portion.

Finally in that form of embodiment of the invention which is most especially preferred the fabric of the slipforming or of the jacket-forming part consists of two layers of elastic fabric or like resilient cloth each one of which is in registering extension of the fabric of one of the upper thighs and possibly of the corresponding side or flank, each upper thigh and flank or side comprising only one single layer of elastic fabric the lines of force of which run in parallel relation to each other and are directed in such a manner that these lines of force are crossed in the slip-like or jacket-forming part or plastron-like portion.

The invention will be better understood and further objects, characterizing features, details and advantages thereof will appear more clearly as the following explanatory description proceeds with reference to the accompanying diagrammatic drawings given by way of non limiting examples only illustrating several presently preferred specific embodiments of the invention and wherein.

Figure 12:
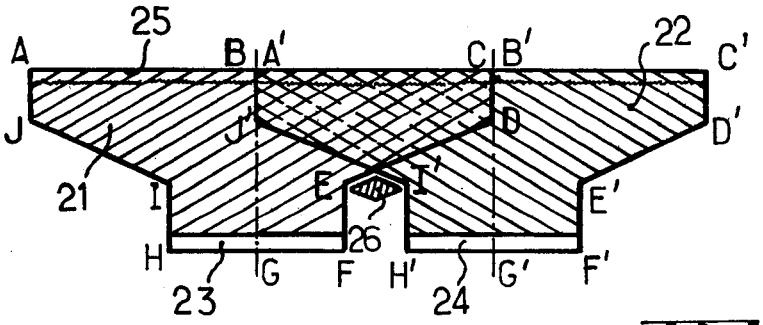
Figure 13:
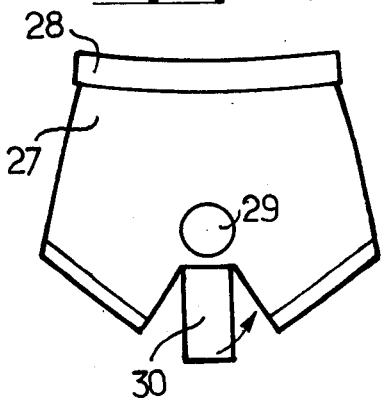
Figure 14:
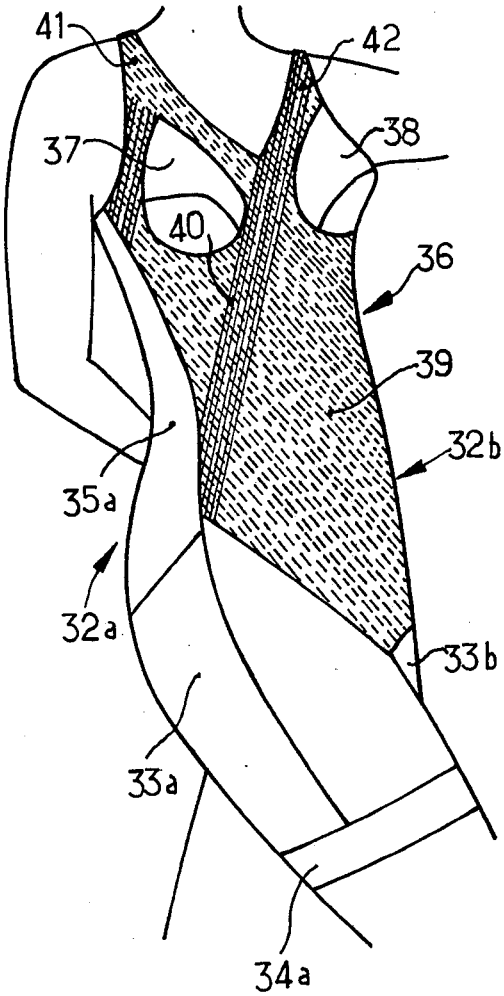

FIG. 12 diagrammatically shows prior to being assembled the three essential pieces used for making a pantie girdle according to a modified embodiment of the invention;

FIG. **12*a* shows another alternative embodiment of the third component piece of the pantie girdle shown in FIG. 12**;

FIGS. 13 and **13*a* illustrate the adaptation or fitting of a pantie girdle according to the invention to a male user or wearer; and FIG. 14** is a showing of an improvement made to the corselet-like combination of belt and brassiere according to the invention.

Figure 1:
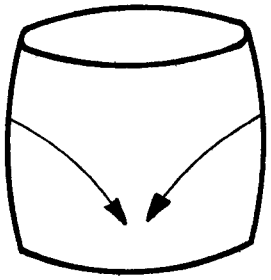
FIGS. 1 and 2 are diagrammatic views showing the directions of the strains or stresses in an abdominal belt and in a pantie girdle, respectively, of the prior known state of the art.
Figure 2:
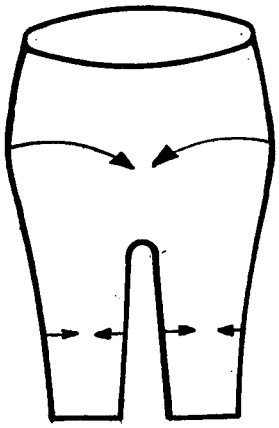
Figure 3:
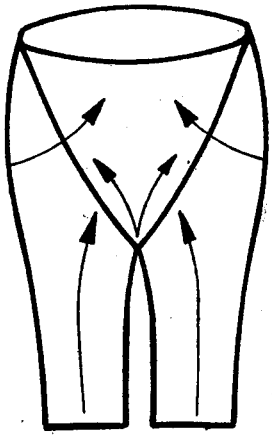
FIG. 3 is a diagrammatic view showing the directions of the elastic tensile stresses in a pantie girdle according to the present invention.

In FIGS. 1 to 3 there has been shown by means of arrows the directions and senses of the forces exerted by the elastic fibres of the various belts or girdles; it is found that with the prior art of abdominal belt shown in FIG. 1 the abdomen is squeezed or tightened as well as the perineum; it is also seen when looking at FIG. 2 that the known pantie girdle which is shown in this Figure would tighten the abdomen and also squeeze the thighs although it may relieve the strain or ease pressure on the perineum.

On the contrary with the pantie girdle according to the present invention the directions and senses of the forces exerted by the resilient fibres are promoting the motions and preventing the tightening or squeezing action whereas the perineum is raised or lifted up and no effect of reducing the abdomen and the thighs is brought about.

Figure 4:
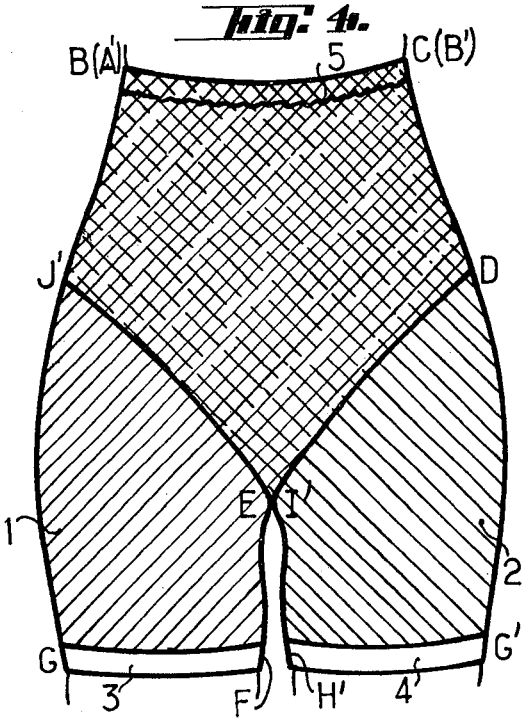
FIG. 4 is a view of the front part of an abdominal belt according to the preferred form of embodiment of the present invention, this belt being shown in the worn state; FIG. **4*a* diagrammatically shows before being assembled both essential pieces used for making the pantie girdle shown in FIG. 4**.

The front part of the abdominal belt shown in FIG. 4 consists of a pair of elastic fabric elements BCDEFGB and A'B'G'H'I'J', respectively; in each of these elements the directions of the elastic fibres, i.e., the lines of force are the same, the lines of force being diagrammatically shown as lines 1 for the element corresponding to the right-hand portion of the body, i.e. the element BCDEFGB and as lines 2 for the element corresponding to the left-hand portion of the body, i.e. the element A'B'G'H'I'J'; in the form of embodiment shown the inclination of these lines with respect to the longitudinal direction of the girdle is about 45° these lines being accordingly crossed at the slip-forming area B (A') C(B') DI'EJ' which consists of the superposition of both aforesaid elements; in the exemplary embodiment shown the top portion of the member A'B'G'H'I'J'A' extends below (that is on the inner side of the girdle) the top portion of the member BCDEFGB. The upper thighs J'EFGJ' and DG'H'I'D will therefore be provided by those parts of the aforesaid elements which are not arranged in overlying relationship; in each one of these upper thighs the lines of force are therefore extending in parallel relation to each other these lines being directed upwards and towards the centre line axis of the girdle for each one of the sides of the latter.

Both aforesaid elements are kept together by being secured or fastened to each other preferably along the areas J'E and DI' by means of sewing or stitching, bonding, gluing or sticking or any other suitable means.

The girdle may of course comprise any auxiliary suitable elements in particular intended for ornamental purposes such as annular small strips, narrow bands or ribbons 3 and 4 and the border or edging 5.

The back side or rear face of the girdle preferably has the same construction and exhibits the same appearance; the back portion may be made in a similar manner by means of two other elements overlapping each other at their top portions so that the lines of force running in parallel relation to each other of each element are crossing each other from one element to the other in that area where these elements are overlapping; the assembling of the elements of the front face with the back face would then be accomplished along the areas BJ'G, CDG', EF and I'H'.

It is however more advantageous that said areas do not comprise seams or joints for esthetic reasons and/or better comfort by making the whole girdle of two elements of like shapes such as those ABCDEFGHIJA and A'B'C'D'E'F'G'H'I'J'A' shown in FIG. 4*a;* in such a case it would be enough to superpose the outline BCDE upon the outline A'B'KI', to fold both elements after having assembled them on the fore-part as stated hereinabove about the straight lines BG and B'G' and to proceed in the same way through superposition and assembling for providing the back face of the girdle by means of the end portions of both aforesaid elements.

The aforesaid girdle offers the following advantages:

it will slenderize or slim the figure by reducing the abdomen and the thighs and this as stated hereinabove without tightening or squeezing same;

it removes tiredness by supporting or backing the perineum which is a naturally weak zone and which in the standing position is bearing the weights of the viscera or internal organs; thus the abdominal contents tend to be pushed or forced upwards owing to the girdle according to the present invention;

it contributes to a graceful gait or bearing contrary to the usual girdles which would impose a scissor-like walk;

it will preserve the use of the tissues due to its supporting action upon the bladder, the womb and the rectum;

it will harden or strengthen the perineum through resilient biasing action of the abdominal muscular contractions and correction of the slackenings which unavoidably occur when becoming older or after a confinement or childbirth;

it will promote the circulation of blood in the abdominal region at every movement of the hip and at every step;

it will strengthen the whole abdominal and perineal musculature as well as the specific muscles of the urethra, vagina and anus;

it enables to heal or cure the prolapses of average magnitude which otherwise would have required a surgical operation;

it will remove or alleviate lumbar pains which are generally occuring in the evening with conventional girdles; it will facilitate the removal of excess fatty masses, slenderizing or slimming the thighs and the abdomen area; and it is likely to cope with frigidity caused by the slackening of the perineum which would be perfectly corrected.

Figure 5:
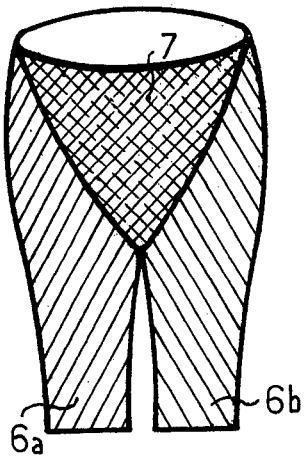
FIGS. 5, 6 and 7 show various alternative embodiments of a pantie girdle according to the present invention.

In the form of embodiment shown in FIG. 5 the obliquity of skew of the lines of force of the upper thighs 6a and 6b of the pantie girdle with respect to the longitudinal centre line axis of the latter is about 30° this direction being closer to the vertical direction than in the case of FIG. 4; the slip-forming member 7 is independent here and it consists of the superposition of two triangular elements in each one of which the lines of force extend in parallel relation to each other these lines of force crossing from one element to the other as shown in that figure.

Figure 6:
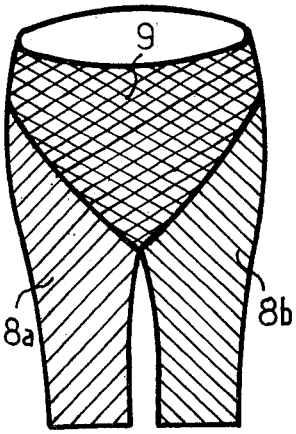

In the form of embodiment shown in FIG. 6, the upper thighs 8*a* and 8*b* and the slip-like portion 9 consist of separate elements; the slanting or skew of the lines of force representing the elastic fibres of the fabric is about 45° in the upper thighs; on the other hand this obliquity is about 60° in the slip 9 which consists of one single fabric layer in which the resilient fibres are crossing along two directions making an angle of 60°.

Figure 7:
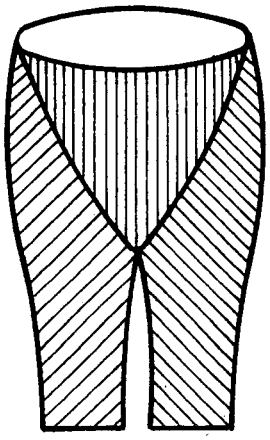

In the alternative embodiment of FIG. 7 also according to the present invention the slip-like part consists of a fabric the elastic fibres of which are arranged longitudinally whereas in those parts forming the upper thighs these fibres exhibit a skew of 45° as shown.

Figure 4A:
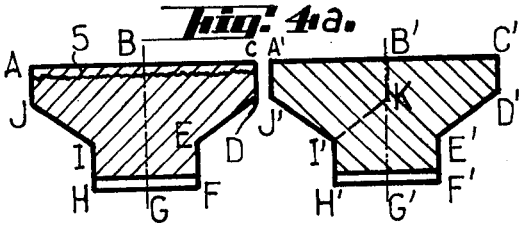
Figure 8:
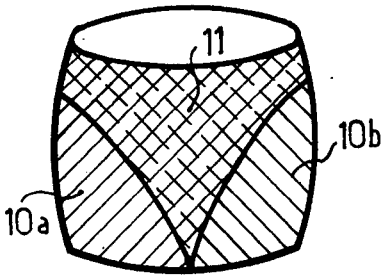
FIG. 8 illustrates the front face of a ladies' roll-on abdominal belt according to the present invention.
Figure 9:
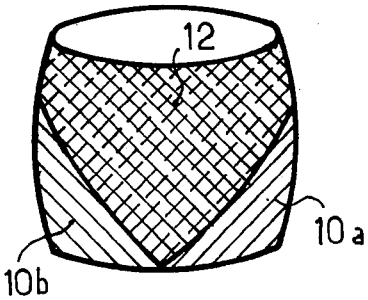

FIGS. 8 and 9 show the front face and the back face, respectively, of an abdominal roll-on belt according to the present invention which only consists as in the case of FIG. 4*a* of two elements which provide each one an upper thigh 10*a* and 10*b*, respectively, in those areas where these elements do not overlap each other and which form, in those areas where they are overlapping, the front of fore-part 11 and the back 12 of the slip-like portion, in which portion as shown the lines of force with an obliquity of 45° are again crossing each other.

Figure 10:
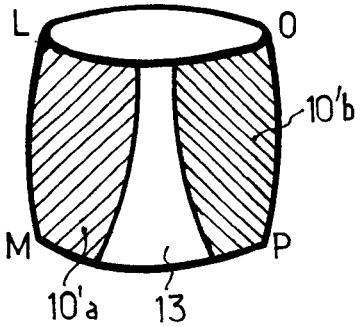
FIGS. 9 and 10 illustrate two forms of embodiment, respectively, of the rear face or back side of the abdominal belt shown in FIG. 8.

FIG. 10 corresponds to the back face of a roll-on belt the front of which may be that shown in FIG. 8; owing to the orientations of the lines of force of the elements 10'*a* and 10'*b* which form the rear part or back side of the upper thighs, these elements are here separate from the corresponding front elements and assembled thereto along the lines LM and OP; the element 13 of the back part is of the elastic or non elastic type.

According to another alternative embodiment not shown the members 10'*a* and 10'*b* could include registering extensions the lines of force of which would cross each other at the area 13.

Figure 11:
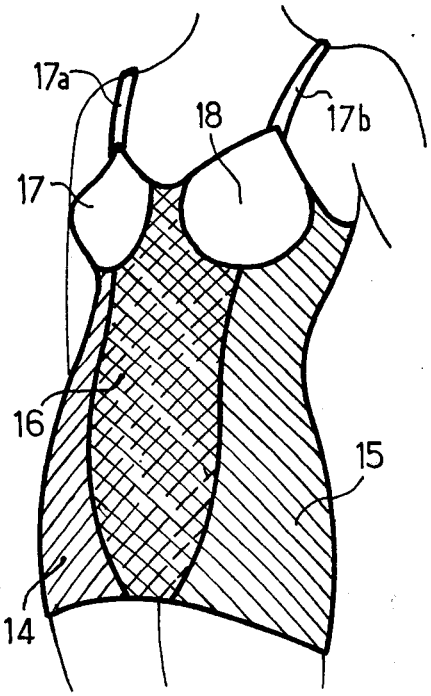
FIG. 11 shows a combination of a roll-on belt and brassiere or bust-bodice forming a corselet according to the present invention.

The corselet shown in FIG. 11 comprises two parts 14 and 15 which form the upper thighs and the flanks or sides, a plastron or front part 16 and cups 17 and 18 which are connected to the back of the corselet by shoulder-straps 17*a* and 17*b* which may possibly be crossed on the front side, one shoulder-strap extending from the left cup towards the right shoulder whereas the other one extends from the right cup towards the left shoulder thereby resulting in the effect of decreasing the hindering action upon the circulation of venous blood in the arms and of decreasing the tendency to the formation of marks or prints by the straps upon the shoulders.

The lines of force of the parts 14 and 15 are here directed substantially at 45° whereas as in the case of FIGS. 4 and 4*a* or in the case of FIGS. 8 and 9 the central portion, i.e., the plastron or front part 16 in the present instance is provided by the superposition of the registering extensions of the parts 14 and 15 so that at the area of this plastron the lines of force are arranged in crossing or intersecting relationship.

The girdles described hereinabove would of course exhibit the same advantages as those stated in respect of the pantie girdle of FIG. 4.

The belts or girdles according to the present invention may also form maternity corsets since they would quite well bear or hold the body without tightening or squeezing same.

The change or replacement of maternity corsets by adapting larger size in accordance with the evolution or development or pregnancy may be carried out under particularly economical conditions on account of the reduced cost price of the corset according to the present invention forming a maternity corset with respect to the cost price of a conventional maternity corset. More frequently two changes or replacements of the maternity corset according to the invention will be enough during the pregnancy.

The abdominal belt shown in FIG. 12 is a modification of that depicted in FIGS. 4 to 10 and more particularly in FIGS. 4 and 4*a*. Thus the front part of the abdominal belt consists of two elements made from elastic fabric BCDEFGB and A'B'G'H'I'J', respectively, wherein the lines of force are diagrammatically shown as lines 21 and 22, respectively. In the form of embodiment shown the top portion of the element A'B'G'H'I'J-'A' extends underneath the top portion of the element BCDEFGB, the upper thighs J'EFGJ' and DG'H'I'D consisting of those portions of the aforesaid elements which are not arranged in overlying relationship. Ornamental members such as small strips, narrow bands or like tapes or ribbons 23 and 24 and the border or edging 25 are also provided.

In addition the area forming the crotch comprises a textile piece 26 having the shape of a quadrilateral exhibiting at least one axis of symmetry and having in particular the shape of a rhombus or lozenge.

The assembly of all of the three pieces is performed in a manner similar to that previously described. In particular both elements made from elastic fabric are after having been assembled on the front folded back about the straight lines BG and B'G' to form the front face and then the process is performed in the same fashion to constitute the back face of the pantie girdle. All of these operating steps are carried out so as to leave a space or gap enabling to fit the textile piece 26 for instance by sewing or stitching or by any other conventional process.

Figure 12A:
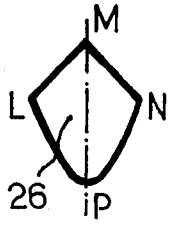

The shaping of this textile piece is for instance that shown in FIG. 12*a*. The piece LMNP is a quadrilateral two sides PL and PN of which are curvilinear. The textile piece 26 may of course exhibit various shapes and also be made from elastic fabric.

Figure 13A:
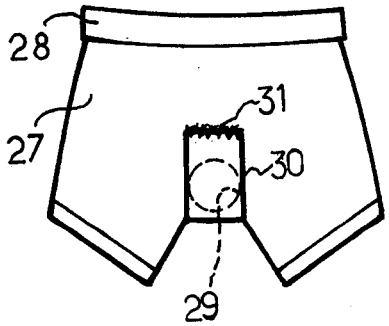

The form of embodiment shown in FIGS. 13 and 13*a* relates to a pantie girdle more especially adapted to be used by a male wearer. The pantie girdle shown comprises a slip-like part 27 provided with a resilient waistband 28 at its top portion. The slip-like part 27 consists of at least one layer of elastic fabric of the kind already described. In the vicinity of the central front part of the slip 27 is provided a cut-out or opening 29 whereas a fabric strip 30 forming a tab, tongue or the like is provided. FIG. 13*a* shows a fabric strip 30 in the folded-back or turned-up position, said fabric strip having been secured as by sewing to the portion 27.

In this form of embodiment the advantages described with reference to FIGS. 1 to 11 will also hold true.

The combination of a blet and brassiere forming a corselet shown in FIG. 14 comprises two parts 32*a*, 32*b* which form the flanks or sides such as 35*a* and the upper thighs 33*a*, 33*b* provided with annular narrow bands or small strips such as 34*a*.

The plastron or fore-part 36 and the slip-like portion consist of two layers of elastic fabric. In each one of these layers the lines of force 59 and 40, respectively, are running in parallel relation to each other. Each one of these two layers or plies is preferably in registering extension of or alignment with corresponding layers or plies made from elastic fabric of the remaining portion of the corselect so that the lines of force 39 of one of the plies or layers will cross or intersect each other with respect to the lines of force 40 of the other ply or layer. Both of these two fabric layers or plies extend up to the portions 41, 42 holding the corselet when the latter is worn by a female user. Finally cups 37 and 38 are also provided at the upper portion of the plastron or front part 36.

The lines of force 39 and 40 of both plies or layers of elastic fabric forming the plastron or fore-part 36 and the portions 41 and 42 located at the shoulder area are directed. here substantially according to an angle of 30° with respect to the longitudinal centre line axis of the coreslet. Such an orientation of the lines of force may of course be easily achieved whatever the type of belt or girdle according to the invention may be.

Moreover, the structure of the plastron defined in FIG. 14 avoids the necessity of providing added or set-in shoulder-straps thereby facilitating the manufacture of said corselet.

The advantages of the corselet or combination of belt and brassiere according to the invention are the following.

In the first place, the arrangement crossed from one shoulder to the other of the lines of force of both elastic fabric plies or layers forming the corselet in such that the corselet according to the invention is adapted to equally bear the weight of the bosoms and thereby to properly provide for the support of the breast while constituting at the same time a support for the ventral part of the body.

Moreover, the invention may on account of the foregoing apply to the making of bust-bodices or brassieres provided or not with skirts or tails, i.e., with parts located below the cups so as to form long-line brassieres. In particular, the brassiere-forming belt thus obtained is made for its major part from elastic fabric extending up to the shoulder area and preferably consists of two fabric layers of plies the lines of force of which run in parallel relation to each other in the same layer and are crossing or intersecting with said other from one layer to the other.

Also the invention may be applied to the making of bathing suits or the like.

The invention should of course not at all be limited to the forms of embodiment described and shown which have been given by way of illustrative examples only. In particular, it comprises all the means constituting technical equivalents of the means described as well as their combinations if same are carried out according to its gist and used within the scope of the appended claims.

What is claimed is:

1. A slenderizing and comfort-improving elastic underwear garment, comprising two assembled component panels of like shape made of elastic fabric having parallel resilient fibres defining lines of force, each panel having a longitudinal axis and being of a shape consisting of first and second substantially rectangular portions of different sizes interconnected by an intermediate trapezoidal portion, the first rectangular portion being of greater size than the second rectangular portion, said lines of force of the elastic fabric extending in each panel obliquely with respect to the longitudinal axis thereof, said panels being partially superposed in said garment and forming overlapping portions in which longitudinal edges of the first rectangular portion of each of said panels are assembled onto the other of said panels along the longitudinal axis thereof, said lines of force of said panels being crossed in said overlapping portions.

2. An underwear garment according to claim 1, wherein the said second rectangular portions of the panels form upper thighs of the garment, and the first rectangular portions and the intermediate trapezoidal portions form a slip portion of the garment.

3. An underwear garment according to claim 2, further comprising a textile piece having a quadrilateral shape and assembled to the panels at the crotch-forming area of said garment.

4. An underwear garment according to claim 1, wherein the lines of force of each panel form with a longitudinal center line axis of the garment an angle comprised between about 30° and about 60°.

5. An underwear garment according to claim 4, wherein said angle is about 45°.

* * * * *